United States Patent [19]

Higashida et al.

[11] 4,404,270

[45] Sep. 13, 1983

[54] POSITIVELY CHARGEABLE POWDERED ELECTROPHOTOGRAPHIC TONER CONTAINING DIALKYL TIN OXIDE CHARGE CONTROL AGENT

[75] Inventors: Osamu Higashida; Isamu Moribe, both of Hitachi; Hajime Yamamoto, Kyoto, all of Japan

[73] Assignee: Hitachi Chemical Company, Ltd., Tokyo, Japan

[21] Appl. No.: 267,577

[22] Filed: May 21, 1981

[30] Foreign Application Priority Data

| | | | |
|---|---|---|---|
| May 22, 1980 | [JP] | Japan | 55-68651 |
| May 22, 1980 | [JP] | Japan | 55-68652 |
| May 22, 1980 | [JP] | Japan | 55-68653 |
| Oct. 3, 1980 | [JP] | Japan | 55-139033 |
| Oct. 3, 1980 | [JP] | Japan | 55-139034 |
| Oct. 3, 1980 | [JP] | Japan | 55-139035 |

[51] Int. Cl.[3] ..... G03G 9/08

[52] U.S. Cl. ..... 430/110; 430/465

[58] Field of Search ..... 430/110, 465

[56] References Cited

U.S. PATENT DOCUMENTS

| | | | |
|---|---|---|---|
| 3,236,639 | 2/1966 | Tomanek et al. | 430/120 X |
| 3,262,806 | 7/1966 | Gourge | 430/103 |
| 3,577,345 | 8/1971 | Jacknow et al. | 430/109 |
| 3,840,464 | 10/1974 | Van Engeland | 430/108 |
| 3,893,935 | 7/1975 | Jadwin et al. | 430/110 |

*Primary Examiner*—John D. Welsh

*Attorney, Agent, or Firm*—Antonelli, Terry & Wands

[57] ABSTRACT

A toner comprising a resin, a colorant and a positive charge control agent selected from the group consisting of mica, monoalkyl and dialkyl tin oxides and urethane compounds, said charge control agent having high positive charging ability and good dispersibility in the resin, can be used for developing to give good quality images, having high density in the image areas and low background in the non-image areas.

5 Claims, No Drawings

POSITIVELY CHARGEABLE POWDERED ELECTROPHOTOGRAPHIC TONER CONTAINING DIALKYL TIN OXIDE CHARGE CONTROL AGENT

BACKGROUND OF THE INVENTION

This invention relates to a positively chargeable toner used in electrophotography and electrostatic recording, more particularly to a positively chargeable toner suitable for carrying out color development in the above-mentioned fields.

As developing methods in these fields, there has been known a dry developing method wherein there is used a developer prepared by mixing fine toner particles containing a charge control agent with a carrier particles such as glass beads, iron powders, or the like. As the positive charge control agent used for positively chargeable toner in the dry development, there has been known, for example, fatty acid modified nigrosines as disclosed in U.S. Pat. No. 3,647,696. But since these charge control agents are colored in dark brown, they can be used in black toners using carbon black as a colorant but cannot be used for blue, yellow, red and the like color toners. U.S. Pat. No. 4,021,358 discloses polyamine resins as a positive charge control agent. These charge control agents are colorless and can be used for color toners, but they have disadvantages in that their compatibility with resins is poor and their dispersibility is also poor. Further, there is another disadvantage in that when a toner is produced by a melt kneading process, an unpleasant amine odor is released.

SUMMARY OF THE INVENTION

It is an object of this invention to provide a positively chargeable toner improving such disadvantages mentioned above.

This invention provides a toner which can be charged positively comprising (a) a resin, (b) a colorant, and (c) a positive charge control agent selected from the group consisting of mica, dialkyl tin oxides, monoalkyl tin oxides and urethane compounds.

DETAILED DESCRIPTION OF THE INVENTION

As the resin, there can be used conventional resins having a glass transition temperature of 40° C. or more and 150° C. or less such as polystyrene resins, acrylic resins, epoxy resins, polyester resins, etc. Examples of these resins are polymers and copolymers of unsaturated compounds such as polystyrene, polychlorostyrene, poly($\alpha$-methylstyrene), styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic acid ester copolymers (e.g., styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylic acid ester copolymers (e.g., styrene-methyl methacrylate copolymer, styrene-ethyl methacrylate copolymer, styrene-butyl methacrylate copolymer, styrene-octyl methacrylate copolymer, styrene-phenyl methacrylate copolymer, etc.), styrene-methyl $\alpha$-chloroacrylate copolymers, styrene-acrylonitrile-acrylic acid ester copolymers, and the like. Examples of the epoxy resins usable in this invention are those preferably having an epoxy equivalent of 900 to 3500. Particularly preferable examples of the epoxy resins are Epikote 1004, Epikote 1007, Epikote 1009 (manufactured by Shell Chemical Co.), Araldite GY 6084,, Araldite GY 6097, Araldite GY 6099 (manufactured by Ciba-Geigy Corp.) and the like.

Examples of the polyester resins usable in this invention are polycondensation products from polyhydric alcohols and polybasic acids. Preferable examples of polyhydric alcohols are ethylene glycol, glycerin, 1,2-propylene glycol, 1,3-propylene glycol, neopentyl glycol, 1,4-butanediol, 1,6-hexanediol, 1,4-cyclohexanedimethanol, trimethylol ethane, trimethylolpropane, pentaerythritol, and the like.

Preferable examples of polybasic acids are maleic acid, fumaric acid, isophthalic acid, terephthalic acid, adipic acid, sebacic acid, trimellitic acid, pyromellitic acid, and their anhydrides and their derivatives. These resins can be used alone or as a mixture thereof as the component (a).

As the colorant, the component (b), there can be used conventional pigments such as carbon black, Phodamine 6G Lake, Phthalocyanine Blue, Phthalocyanine Green, Hansa Yellow G, Watchung Red Ba, Watchung Red Li, and the like; conventional dyes such as monoazo dyes, disazo dyes, metal complex type monoazo dyes, anthraquinone dyes, phthalocyanine dyes, triallylmethane dyes, and the like. These colorants can be used alone or as a mixture thereof as the component (b).

The colorant is preferably used in an amount of 0.1 to 50 parts by weight per 100 parts by weight of the resin. The amount of the colorant is determined considering other conditions, purposes, and the like and can exceed 50 parts by weight in some cases.

As the positive charge control agent, the component (c), there can be used at least one member selected from the group consisting of mica, dialkyl tin oxides, monoalkyl tine oxides and urethane compounds.

As to mica, although it is colored in light yellow, pink or purple, such a color does not give bad influence on producing color toners. Further since mica can be dispersed in the resin well, there can advantageously be obtained uniformly charged toners. As the mica, there can be used muscovite, biotite, phlogopite, lepidolite, and the like conventionary used ones. Typical examples are muscovite ($KAl_2(AlSi_3)O_{10}(OH)_2$), phlogopite ($KMg_3(AlSi_3)O_{10}(OH)_2F_2$), lepidolite ($K_4Mg_{0-4}Fe^{II}_{0-4}Li_{4-6}Al_{7-8}Si_{12-14}(OH)_{2-4}F_{2-7}$), etc.

As to the dialkyl tin oxide and monoalkyl tin oxide, since they are colorless, they can advantageously be used for particularly producing color toners. Further, since dispersion of alkyl tin oxide in the resin is good, there can advantageously be obtained uniformly charged toners.

Examples of the dialkyl tin oxides are dibutyl tin oxide, dimethyl tin oxide, diethyl tin oxide, etc. Examples of the monoalkyl tin oxides are monobutyl tin oxide, monomethyl tin oxide, monoethyl tin oxide, etc.

As to urethane compounds, since they are colorless, they can advantageously be used for particularly producing color toners. Further, since dispersion of the urethane compounds in the resin is good, there can advantageously be obtained uniformly charged toners.

As the urethane compounds, those having one or more urethane linkages are usable. Among them, those having 500 or less urethane linkages are preferable.

These urethane compounds can be obtained by reacting a mono- or polyvalent isocyanate with a compound having one or more hydroxyl groups in the molecule by using a conventional process. Examples of mono- or polyvalent isocyanates are phenyl isocyanate, tolylene diisocyanate, isophorone diisocyanate, xylylene diisocyanate, diphenylmethane diisocyanate, hexamethylene diisocyanate, and the like. Examples of compounds having one or more hydroxyl groups in the molecule are phenols such as phenol, bisphenol A, etc.; alcohols such as ethylene glycol, 1,3-propylene glycol, neopentyl glycol, 1,4-butanediol, 1,6-hexanediol, 1,4-cyclohexanediol, trimethylolethane, trimethylolopropane, pentaerythritole, and the like. The urethane compounds used in this invention include those obtained by blocking with a masking agent such as ϵ-caprolactam, etc., a part or whole of the isocyanate group remaining in a urethane compound obtained by reacting an isocyanate with a compound having at least one hydroxyl group in the molecule.

The charge control agent is preferably used in an amount of 1 to 15% by weight in the case of mica, 0.5 to 10% by weight in the case of the monoalkyl and dialkyl tin oxides and 1 to 50% weight in the case of the urethane compounds based on the total weight of the toner. If the amount is too small, for example, less than 0.5% by weight in the case of the monoalkyl and dialkyl tin oxides or less than 1% by weight in other cases, the toner is insufficient in a positive charge and cannot be used practically. On the other hand, if the amount is too excessive, for example, more than 50% by weight in the case of the urethane compounds, more than 10% by weight in the case of the monoalkyl and dialkyl tin oxides or more than 15% by weight in other cases, since the toner is excessive in a positive charge and increases its electrostatic attraction for glass beads, iron powders or the like used as a carrier, there undersirably take place lowering in fluidity of the developer and lowering in the image density.

The toner of this invention may further contain conventional additives such as colloid silica, metal salts of fatty acids, fluorine polymers, silicon oil, and the like depending on the necessity.

This invention is illustrated in detail by way of the following Examples, in which all parts are by weight.

EXAMPLE 1

96 Parts of styrene-butyl methacrylate copolymer, 1 part of Rhodamine 6G Lake pigment as a colorant and 3 parts of mica (Takara Mica M-1, manufactured by Shiraishi Calcium Co., Ltd.) as a charge control agent were dry mixed and then melt mixed. After cooling, the mixture was crushed coarsely by using a hammer mill, followed by fine crushing by using an air-jet type pulverizer. The resulting fine powder was classified to select a powder of 5 to 30 μm as a toner. To 3 parts of the toner, 100 parts of spherical iron oxide beads was added and mixed to give a developer. The developer had a toner charge to mass ratio of +19.0 (μC/l g toner), which was measured by the blow-off method.

For comparison, a toner containing no mica was prepared and used for giving a developer in the same manner as mentioned above. The resulting developer had a toner charge to mass ratio of +8.2 (μC/l g toner).

Transferred images were obtained by using those toner particles as follows: After uniformly charging a selenium drum rotating at a peripheral speed of about 10 cm/sec with a corrona voltage of +5 kV, the selenium drum was exposed to light through a negative manuscript image, then, reverse development was conducted by using developers containing iron oxide beads and toner particles by magnetic brush development to give a positive manuscript image of toner particles on the selenium drum, followed by charging of a corona voltage of −5 kV from the rear side of usual copy paper (plain paper) to give a transferred image on the paper.

When the toner containing mica was used, the resulting image was of good quality, having high density in the image areas, and low background in the non-image areas.

On the other hand, when the toner containing no mica was used, there took place a toner throw-off from the magnetic brush and the resulting image was of poor quality, having lower density in the image areas, and higher background in the non-image areas.

EXAMPLE 2

A toner was prepared in the same manner as described in Example 1 except for using as a colorant Phthalocyanine Blue in place of Rhodamine 6G Lake. For comparison, a toner containing no mica was also prepared similarly. Developers were prepared in the same manner as described in Example 1. The toner charge to mass ratio of the developer containing mica was +13.0 (μC/l g toner) and that of the developer containing no mica was +0.3 (μC/l g toner).

Transferred images were obtained in the same manner as described in Example 1. When the toner containing mica was used, the resulting image was of good quality, having high density in the image areas, and low background in the non-image areas.

On the other hand, when the toner containing no mica was used, there took place a toner throw-off from the magnetic brush and the resulting image was of poor quality, having lower density in the image areas, and higher background in the non-image areas.

EXAMPLE 3

A toner was prepared in the same manner as described in Example 1 except for using as a charge control agent dibutyl tin oxide in place of mica. For comparison, a toner containing no dibutyl tin oxide was also prepared similarly. Developers were prepared in the same manner as described in Example 1. The toner charge to mass ratio of the developer containing dibutyl tin oxide was +42.5 (μC/l g toner) and that of the developer containing no dibutyl tin oxide was +8.2 (μC/l g toner).

Transferred images were obtained in the same manner as described in Example 1. When the toner containing dibutyl tin oxide was used, the resulting image was of good quality, having high density in the image areas, and low background in the non-image areas.

On the other hand, when the toner containing no dibutyl tin oxide was used, there took place a toner throw-off from the magnetic brush and the resulting image was of poor quality, having lower density in the image areas, and higher background in the non-image areas.

EXAMPLE 4

A toner was prepared in the same manner as described in Example 3 except for using as a colorant Phthalocyanine Blue in place of Rhodamine 6G Lake. For comparison, a toner containing no dibutyl tin oxide was also prepared similarly. Developers were prepared in the same manner as described in Example 1. The toner charge to mass ratio of the developer containing dibutyl tin oxide was +35.0 (μC/l g toner) and that of the developer containing no dibutyl tin oxide was +0.3 (μC/l g toner).

Transferred images were obtained in the same manner as described in Example 1. When the toner containing dibutyl tin oxide was used, the resulting image was of good quality, having high density in the image areas, and low background in the non-image areas.

On the other hand, when the toner containing no dibutyl tin oxide was used, there took place a toner throw-off from the magnetic brush and the resulting image was of poor quality, having lower density in the image areas and higher background in the non-image areas.

EXAMPLE 5

A toner was prepared in the same manner as described in Example 1 except for using as a charge control agent an urethane compound (Crelan U502, manufactured by Bayer A.G.: a product obtained by masking with ε-caprolactam the remaining isocyanate group of a compound obtained by reacting 3 moles of isophorone diisocyanate with 1 mole of trimethylolpropane) in place of mica. For comparison, a toner containing no urethane compound was also prepared similary. Developers were prepared in the same manner as described in Example 1. The toner charge to mass ratio of the developer containing the urethane compound was +21.8 (μC/l g toner) and that of the developer containing no urethane compound was +8.2 (μC/l g toner).

Transferred images were obtained in the same manner as described in Example 1. When the toner containing the urethane compound was used, the resulting image was of good quality, having high density in the image areas, and low background in the non-image areas.

On the other hand, when the toner containing no urethane compound was used, there took place a toner throw-off from the magnetic brush and the resulting image was of poor quality, having lower density in the image areas and higher background in the non-image areas.

EXAMPLE 6

A toner was prepared in the same manner as described in Example 5 except for using as a colorant Phthalocyanine Blue in place of Rhodamine 6G Lake. For comparison, a toner containing no urethane compound was also prepared similarly. Developers were prepared in the same manner as described in Example 1. The toner charge to mass ratio of the developer containing the urethane compound was +14.0 (μC/l g toner) and that of the developer containing no urethane compound was +0.3 (μC/l g toner).

Transferred images were obtained in the same manner as described in Example 1. When the toner containing the urethane compound was used, the resulting image was of good quality, having high density in the image areas, and low background in the non-image areas.

On the other hand, when the toner containing no urethane compound was used, there took place a toner throw-off from the magnetic brush and the resulting image was of poor quality, having lower density in the image areas and higher background in the non-image areas.

EXAMPLE 7

A toner was prepared in the same manner as described in Example 1 except for using as a charge control agent monobutyl tin oxide in place of mica and as a colorant Watchung Red Ba in place of Rhodamine 6G Lake. For comparison, a toner containing no monobutyl tin oxide was also prepared similarly. Developers were prepared in the same manner as described in Example 1. The toner charge to mass ratio of the developer containing monobutyl tin oxide was +25.8 (μC/l g toner) and that of the developer containing no monobutyl tin oxide was −9.3 (μC/l g toner).

Transferred images were obtained in the same manner as described in Example 1. When the toner containing monobutyl tin oxide was used, the resulting image was of good quality, having high density in the image areas, and low background in the non-image areas.

On the other hand, when the toner containing no monobutyl tin oxide was used, there took place a toner throw-off from the magnetic brush and the resulting image was of poor quality, having lower density in the image areas and higher background in the non-image areas.

As mentioned above, the special compounds are used as positive charge control agent in this invention. Since these compounds are slightly colored or white or colorless and have high povitively charging ability, toners which can be charged positively with desired color can be obtained without losing the color inherent in colorants. Further since dispersibility of these charge control agents in the resin is good, uniformly charged toners can easily be obtained. When such toners are used for developing, there can be obtained good quality images, having high density in the image areas, and low background in the non-image areas. In addition, when the toner is produced by a melt kneading process, no unpleasant odor is generated.

What is claimed is:

1. A toner which can be charged positively comprising (a) a resin, (b) a colorant, and (c) as a positive charge control agent, a compound selected from the group consisting of dialkyl tin oxides.

2. A toner according to claim 1, wherein the resin is one having a glass transition temperature of 40° C. to 150° C.

3. A toner according to claim 1, wherein the dialkyl tin oxide is used in an amount of 0.5 to 10% by weight based on the total weight of the toner.

4. A toner according to claim 1, wherein the dialkyl tin oxide is dibutyl tin oxide.

5. A toner according to claim 1, wherein said dialkyl tin oxides are selected from the group consisting of dibutyl tin oxide, dimethyl tin oxide and diethyl tin oxide.

* * * * *